US009403257B2

(12) United States Patent
Miura et al.

(10) Patent No.: US 9,403,257 B2
(45) Date of Patent: Aug. 2, 2016

(54) APPARATUS AND METHOD FOR DOUBLE-SIDE POLISHING OF WORK

(71) Applicant: SUMCO CORPORATION, Tokyo (JP)

(72) Inventors: Tomonori Miura, Saga (JP); Hiroto Fukushima, Saga (JP)

(73) Assignee: SUMCO CORPORATION, Tokyo (JP)

( * ) Notice: Subject to any disclaimer, the term of this patent is extended or adjusted under 35 U.S.C. 154(b) by 0 days.

(21) Appl. No.: 14/460,846

(22) Filed: Aug. 15, 2014

(65) Prior Publication Data

US 2015/0065010 A1 Mar. 5, 2015

(30) Foreign Application Priority Data

Aug. 30, 2013 (JP) ..... 2013-180034

(51) Int. Cl.

| | |
|---|---|
| ***B24B 37/013*** | (2012.01) |
| ***B24B 37/08*** | (2012.01) |
| ***B24B 49/04*** | (2006.01) |
| ***B24B 47/12*** | (2006.01) |
| ***B24B 49/12*** | (2006.01) |

(52) U.S. Cl.

CPC ..... *B24B 37/013* (2013.01); *B24B 37/08* (2013.01); *B24B 49/12* (2013.01)

(58) Field of Classification Search

CPC ..... B24B 37/013; B24B 37/08; B24B 47/12; B24B 49/04; B24B 49/37; B24B 49/042; B24B 49/12

See application file for complete search history.

(56) References Cited

U.S. PATENT DOCUMENTS 5,099,614 A * 3/1992 Arai ..... G01B 17/02 451/262
7,137,867 B2 * 11/2006 Nagayama ..... B24B 37/013 451/10
7,147,541 B2 * 12/2006 Nagayama ..... B24B 37/08 451/10
7,614,934 B2 * 11/2009 Onishi ..... B24B 37/013 451/262

(Continued)

FOREIGN PATENT DOCUMENTS

DE 112009001875 T5 6/2011
JP 2000-280171 A 10/2000

(Continued)

OTHER PUBLICATIONS

Office Action issued in Korean family member Patent Appl. No. 10-2014-0112878, dated Jan. 7, 2016 , along with an English translation thereof.

(Continued)

*Primary Examiner* — Dung Van Nguyen

(74) *Attorney, Agent, or Firm* — Greenblum & Bernstein, P.L.C.

(57) ABSTRACT

A double-side polishing apparatus for a work according to the present invention includes one or more work thickness measuring devices and a control unit. The double-side polishing method for a work includes the steps of: first polishing for polishing both surfaces of the work; first measurement for measuring the thickness of the work; in the first measurement step, when the thickness of the work is found to reach the predetermined thickness, terminating the orbital motion of the carrier plate; second polishing both surfaces of the work while the carrier plate performs only rotational motion; second measurement for measuring the thickness of the work at predetermined position(s); and determining a time for terminating polishing based on the result of the measurement of the thickness of the work in the second measurement step.

5 Claims, 5 Drawing Sheets

(56) References Cited

U.S. PATENT DOCUMENTS

| | | | | |
|---|---|---|---|---|
| 8,647,174 | B2 | 2/2014 | Takai | |
| 8,834,230 | B2 | 9/2014 | Furukawa et al. | |
| 8,951,096 | B2 | 2/2015 | Kanzow et al. | |
| 2006/0194511 | A1 | 8/2006 | Nagayama et al. | |
| 2012/0090536 | A1 | 4/2012 | Ishibashi et al. | |
| 2014/0162456 | A1* | 6/2014 | Oba | B24B 37/005 438/693 |
| 2014/0256227 | A1* | 9/2014 | Aoki | H01L 22/12 451/8 |

FOREIGN PATENT DOCUMENTS

| | | | |
|---|---|---|---|
| JP | 2004-047801 | A | 2/2004 |
| JP | 2008-227393 | A | 9/2008 |
| JP | 4384742 | B2 | 12/2009 |
| JP | 2010-030019 | | 2/2010 |
| JP | 2012-529374 | A | 11/2012 |
| KR | 2011-0038685 | A | 4/2011 |
| TW | 201021109 | A | 6/2010 |

OTHER PUBLICATIONS

Office Action issued in German family member Patent Appl. No. 102014112190.2, dated Aug. 4, 2015, along with an English translation thereof.

Office Action issued in Taiwan family member Patent Appl. No. 103117455, dated Mar. 10, 2016, along with an English translation thereof.

* cited by examiner

APPARATUS AND METHOD FOR DOUBLE-SIDE POLISHING OF WORK

TECHNICAL FIELD

The present invention relates to a double-side polishing apparatus and a double-side polishing method for a work. The present invention relates in particular to a double-side polishing apparatus and a double-side polishing method for a work, which allow polishing to be terminated in a timely manner by, while polishing a circular work such as a semiconductor wafer required to have high flatness, ascertaining the thickness of the work accurately.

BACKGROUND ART

In the production of a semiconductor wafer such as a silicon wafer, which is a typical example of a work to be polished, in order to obtain wafers having the flatness quality or the surface smoothness quality controlled with higher precision, a double-side polishing process is typically employed, by which top and rear surfaces of a wafer are polished simultaneously.

Especially in recent years, since semiconductor devices have been miniaturized and the diameter of semiconductor wafers has been increased, the flatness required of semiconductor wafers during light exposure has become more severe. Given this background, there is a strong need for a technique for terminating polishing in a timely manner.

FIG. 1 is a diagram showing the change in the shape of the whole surface of a wafer and the outer periphery thereof with respect to the polishing time in a typical double-side polishing process, with the relationship between the wafer thickness and the carrier plate thickness. In FIG. 1, the diagram on the left shows a cross-sectional shape in the thickness direction of the wafer, and the horizontal axis represents the distance from the wafer, where the radius of the wafer is indicated as R. An enlarged view of the surroundings of the edge of the wafer is shown on the diagram on the right. Here, in general, polishing pads that are elastic bodies are used in double-side polishing to polish the top and rear surfaces of a wafer simultaneously. Accordingly, the wafer is polished as shown in States A to E in FIG. 1.

That is, as shown in FIG. 1, in an initial stage of polishing (State A), the whole surface of the wafer has an upward convex shape, and the wafer greatly sags even in the periphery. Here, the thickness of the wafer is sufficiently larger than the thickness of a carrier plate. Next, as the polishing proceeds (State B), the whole surface of the wafer has become flatter; however, the periphery of the wafer remains sagging. Here, the thickness of the wafer is slightly larger than the thickness of the carrier plate. As the polishing proceeds further (State C), the whole wafer is almost flat and the periphery of the wafer is less sagging. Here, the thickness of the wafer is almost the same as the thickness of the carrier plate. After that, as the polishing proceeds (State D), the shape of the wafer is gradually depressed at the center, and the periphery of the wafer has a raised shape. In State D, the thickness of the carrier plate is larger than the thickness of the wafer. In State E, where the polishing has proceeded further than State D, the center of the wafer has a depressed shape, and the periphery of the wafer has an increased raise. In State E, the thickness of the carrier plate is even larger than the thickness of the wafer, as compared with State D.

In view of the above, in order to obtain a wafer having high flatness over the whole surface and the periphery, wafers have been generally polished such that the wafers have almost the same thickness as the carrier plate, and an operator has adjusted the polishing time to control the process.

However, adjustment of the polishing time performed by an operator has been significantly affected by polishing conditions such as the replacement period for the secondary materials for polishing and the differences in time of the termination of an apparatus. Accordingly, the polishing degree cannot always have been controlled accurately, so it has largely relied on the experience of the operator.

On the other hand, for example, PTL 1 proposes a double-side polishing apparatus for wafers, by which the thickness of a wafer being polished is measured in real time through monitoring holes above an upper plate (or below a lower plate), and the end time of the polishing can be determined based on the result of the measurement.

CITATION LIST

Patent Literature

PTL 1: JP 2010-030019 A

SUMMARY OF INVENTION

Technical Problem

According to the technique described in PTL 1, since the thickness of the wafer is directly measured, the end time of polishing can be determined without being affected by the change in the polishing conditions. In general, batch processing is performed in double-side polishing. However, in the technique of PTL 1, it is difficult to ascertain the position of a wafer where the thickness is measured. In particular, as shown in FIG. 1, since the thickness of a wafer varies between the center and the periphery even after a lapse of the same polishing time, there has been a problem in that the thickness of the wafer cannot always be ascertained accurately by the technique of PTL 1.

The present invention is aimed at solving the above problem and an object thereof is to provide a double-side polishing apparatus and a double-side polishing method for a work, which make it possible to terminate polishing in a timely manner by while polishing a work, ascertaining the thickness of the work accurately.

Solution to Problem

The inventors of the present invention made various studies to solve the above problem.

As a result, they newly found that the thickness of a work can be measured at predetermined positions during polishing, by measuring the thickness of the work while rotating a carrier plate with the orbital motion thereof being stopped. Consequently, the intended object can be achieved advantageously. Thus, they have completed the present invention.

The present invention primarily includes the following features.

A double-side polishing apparatus of the present invention includes rotating surface plates having an upper plate and a lower plate, a sun gear provided at a center portion of each rotating surface plate, an internal gear provided at a peripheral portion of each rotating surface plate, and a carrier plate provided between the upper plate and the lower plate provided with one or more openings for holding the work. The upper plate or the lower plate has one or more holes penetrating from the top surface to the bottom surface of said upper plate or said lower plate. The double-side polishing apparatus comprises one or more work thickness measuring devices which can measure the thickness of each work through the one or more holes in real time while double-side polishing the work; and a control unit for synchronizing the rotation of the sun gear and the rotation of the internal gear.

With this structure, the orbital motion of the carrier plate can be terminated by synchronizing the rotation of the sun gear and the rotation of the internal gear using the control unit, thereby measuring the thickness of the predetermined positions of the work. Thus, the thickness of the work can be ascertained accurately while double-side polishing the work, so that the polishing can be terminated in a timely manner.

Further, the double-side polishing apparatus for a work according to the present invention preferably comprises a control unit for synchronizing the rotation of the sun gear, the rotation of the internal gear, and the rotation of the upper plate or the lower plate having the one or more holes.

With this structure, the rotational motion of the carrier plate and the rotation of the rotating surface plates having one or more holes can be synchronized, thereby improving the throughput for measuring the thickness of the predetermined positions of the work.

Further, in the double-side polishing apparatus for a work according to the present invention, the holes are preferably located such that the thickness of the center of the work can be measured while the carrier plate performs only rotational motion.

With this structure, the thickness of the work can be measured at the center and the periphery of the work, so that the time for terminating double-side polishing can be ascertained considering not only the thickness of the work but also the shape of the work.

Here, "the center of a work" means a region having a radius of 10 mm or less, centered around the center of gravity position of the work in plan view.

Further, "only rotational motion" means a state where the orbital motion of the carrier plate is almost stopped but is not limited to the case where it is stopped completely. The orbital motion of an extent where the measurement of the wafer thickness at predetermined positions is not affected shall be construed as the above-described "only rotational motion".

In addition, in the double-side polishing apparatus for a work according to the present invention, preferably, the number of the work thickness measuring devices is two or more, and the number of the holes is two or more such that when the carrier plate performs only rotation motion, the thicknesses of the work can be measured at two different positions in the diameter direction of the work simultaneously with the two or more work thickness measuring devices.

With this structure, the thickness of the work can be measured at different positions in the diameter direction simultaneously (for example, the center and the periphery of the work). Therefore, not only the thickness of the work but also the shape of the work can be ascertained at a high throughput.

Here, in a double-side polishing method for a work, of the present invention, a work is held by a carrier plate provided with one or more openings for holding the work; the work is sandwiched between rotating surface plates composed of an upper plate and a lower plate; the rotation and the revolution of the carrier plate are controlled by the rotation of a sun gear provided at a center portion of each rotating surface plate and the rotation of an internal gear provided at a peripheral portion of each rotating surface plate; and thus the rotating surface plates and the carrier plate are relatively rotated to simultaneously polish both surfaces of the work. The upper plate or the lower plate has one or more holes penetrating from the top surface to the bottom surface of said upper plate or said lower plate.

The double-side polishing method for a work comprises the steps of: first polishing for polishing both surfaces of the work by the rotation and the revolution of the carrier plate such that the thickness of the work attain a predetermined thickness; first measurement for measuring the thickness of the work through the one or more holes in real time during the first polishing step; in the first measurement step, when the thickness of the work is found to reach the predetermined thickness, terminating the orbital motion of the carrier plate by synchronizing the rotation of the sun gear and the rotation of the internal gear; second polishing both surfaces of the work while the carrier plate performs only rotational motion; second measurement for measuring the thickness of the work at predetermined position(s) through the one or more holes in real time during the second polishing step; and determining a time for terminating polishing based on the result of the measurement of the thickness of the work in the second measurement step.

According to this method, normal polishing can be performed in the first polishing step, whereas the end time of polishing can be determined accurately in the second polishing step by ascertaining the thickness of the wafer at predetermined positions with high precision. Specifically, in this method, the orbital motion of the carrier plate can be stopped by synchronizing the rotation of the sun gear and the rotation of the internal gear, so that the thickness of predetermined positions of the work can be measured. Thus, the thickness of the work can be ascertained accurately while double-side polishing the work, which allows the polishing to be terminated in a timely manner.

Advantageous Effects of Invention

The present invention can provide a double-side polishing apparatus and a double-side polishing method for a work, which make it possible to terminate polishing in a timely manner by while polishing a work, ascertaining the thickness of the work accurately.

DESCRIPTION OF EMBODIMENTS

<Double-Side Polishing Apparatus for Work>

Figure 1:
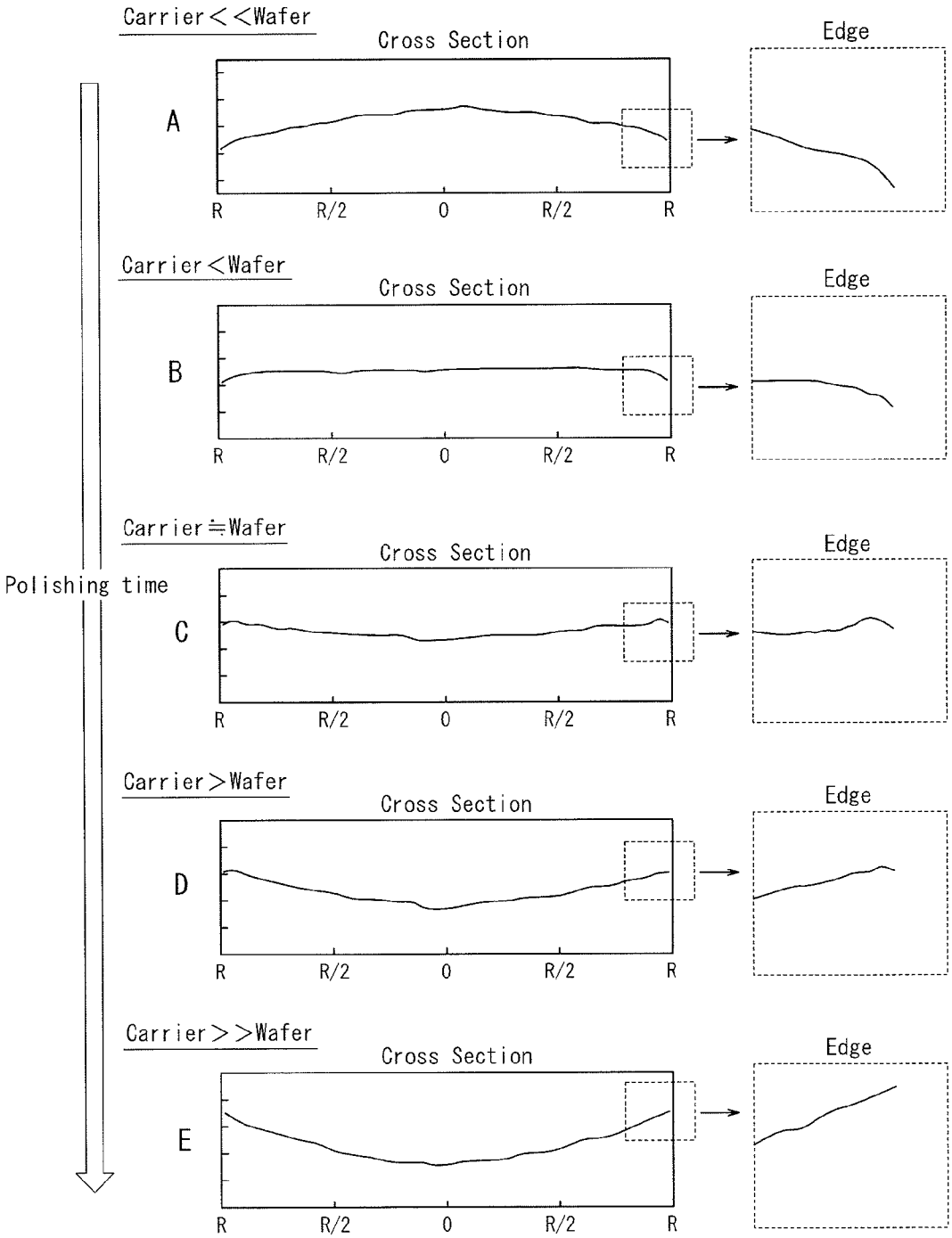
FIG. 1 is a diagram showing the change in the shape of the whole surface of a wafer and the outer periphery thereof with respect to the polishing time, with the relationship between the wafer thickness and the carrier plate thickness.
Figure 2:
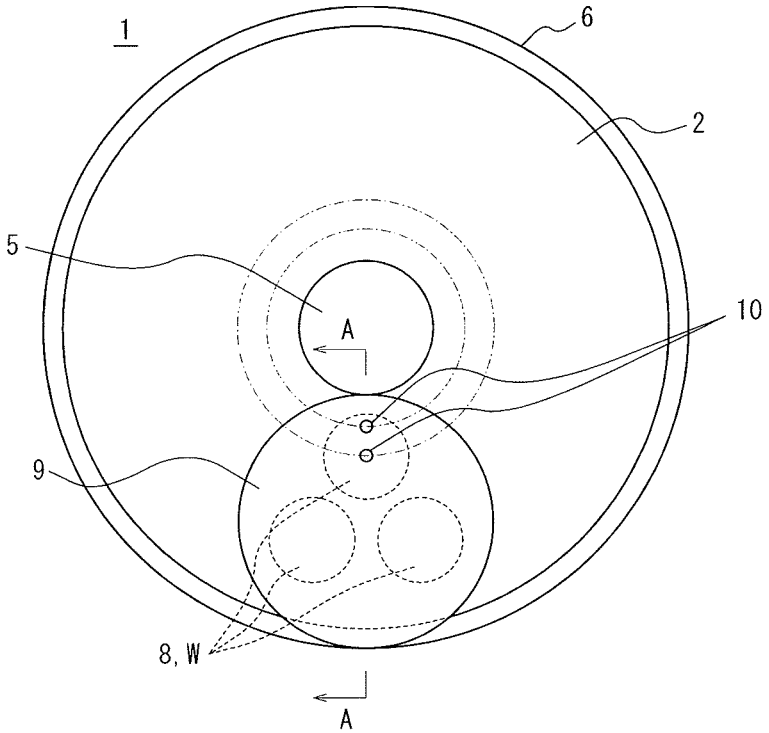
FIG. 2 is a top view of a double-side polishing apparatus for a work, according to one embodiment of the present invention.
Figure 3:
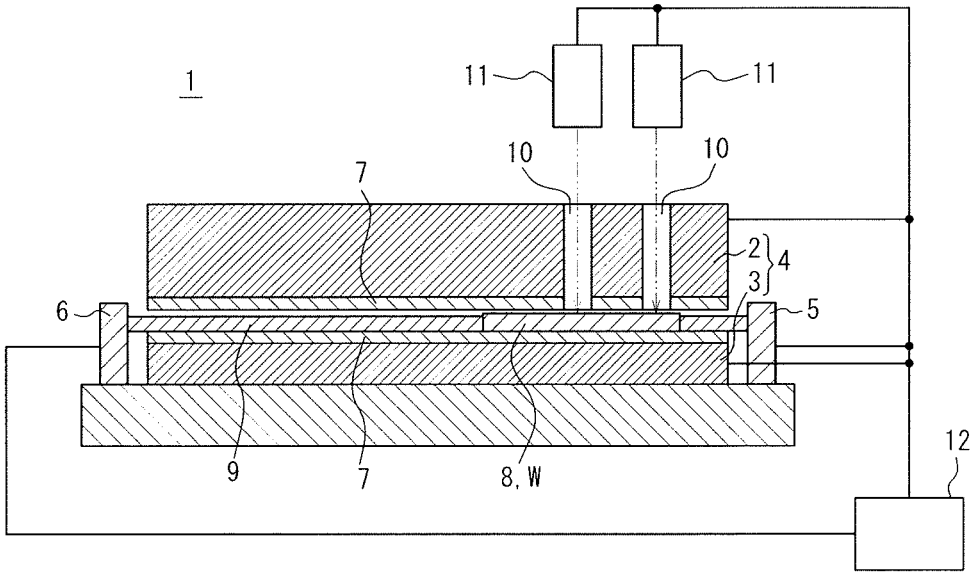
FIG. 3 is a cross-sectional view taken along line A-A in FIG. 2.

Embodiments of a double-side polishing apparatus for a work according to the present invention will be demonstrated in detail with reference to the drawings. FIG. 2 is a top view of a double-side polishing apparatus for a work according to one embodiment of the present invention, whereas FIG. 3 is a cross-sectional view taken along line A-A in FIG. 2. As shown in FIGS. 2 and 3, the double-side polishing apparatus 1 includes rotating surface plates 4 having an upper plate 2 and an opposite lower plate 3; a sun gear 5 provided at the center of rotation of the rotating surface plates 4, and an internal gear 6 provided in a ring shape around the rotating surface plates 4. As shown in FIG. 3, surfaces of the upper and lower rotating surface plates 4 that face each other, namely, the bottom surface of the upper plate 2 that is a polishing surface and the upper surface of the lower plate 3 that is a polishing surface are each provided with a polishing pad 7 attached thereto.

Further, as shown in FIG. 2 and FIG. 3, the apparatus 1 is provided between the upper plate 2 and the lower plate 3, and has one carrier plate 9 in the illustration, having one or more (three in the illustration) openings 8 for holding works. Note that in the illustration, the apparatus 1 has only one carrier plate 9; alternatively, it may have a plurality of carrier plates 9, whereas the number of the openings 8 may be one or more without being limited to three. In the illustration, works (wafers in this embodiment) W are held by the openings 8.

Here, the apparatus 1 is a planetary gearing double-side polishing apparatus which can rotate the sun gear 5 and the internal gear 6 to cause planetary motion involving the orbital motion and the rotational motion of the carrier plate 8. In other words, while supplying a polishing slurry, the carrier plate 9 is made to perform planetary motion and at the same time, the upper plate 2 and the lower plate 3 are relatively rotated with respect to the carrier plate 9, thereby making the polishing pads 7 attached to the upper and lower rotating surface plates 4 slide with the respective surfaces of the wafers W held in the openings 8 of the carrier plate 9; thus, both surfaces of the wafers W can be polished simultaneously.

Further, as shown in FIG. 2 and FIG. 3, in the apparatus 1 of this embodiment, the upper plate 2 is provided with one or more holes 10 penetrating from the top surface of the upper plate 2 to the bottom surface thereof, which is a polishing surface. In the illustration, two holes 10 are apposed in the direction of the diameter of the upper plate 2. Further, in the illustration, one of the two holes 10 is located above the center of one of a wafer W, whereas the other is located above the periphery of the wafer W (a region extending 1 mm in the diameter direction from the edge of the wafer). In this example, the holes 10 are provided in the upper plate 2; alternatively, they may be provided in the lower plate 3. One or more holes 10 may be provided in either the upper plate 2 or the lower plate 3. Further, in the illustrations in FIG. 2 and FIG. 3, two holes 10 are provided; alternatively, a plurality of holes may be placed in the orbits on the upper plate 2 (on the dot-dashed lines in FIG. 2). Here, as shown in FIG. 3, the polishing pad 7 attached to the upper plate 2 is also penetrated by the holes, so that the holes 10 penetrate from the top surface of the upper plate 2 to the bottom surface of the polishing pad 7.

Moreover, as shown in FIG. 3, the apparatus 1 includes, above the upper plate 2 in the illustration, one or more (two in the illustration) work thickness measuring devices 11 which can measure the thicknesses of the wafers W through the one or more (two in the illustration) holes 10 in real time during double-side polishing of the wafers W. In this example, the work thickness measuring devices 11 are wavelength tunable infrared laser devices. For example, the work thickness measuring devices 11 may include an optical unit for irradiating the wafers W with a laser beam, a detection unit for detecting the laser beam reflected from the wafer W, and an arithmetic unit for calculating the thickness of the wafer W from the detected laser beam. Such work thickness measuring devices 11 makes it possible to calculate the thickness of the wafers W from the difference between the optical path lengths of a reflection component of the laser beam incident on the wafer W, reflected off the front surface of the wafer and a reflection component thereof reflected off the rear surface of the wafer W. Note that the work thickness measuring devices 11 may be of any type as long as the thickness of works can be measured in real time; accordingly, they are not limited in particular to the type using infrared laser as described above.

Further, as shown in FIG. 3, the double-side polishing apparatus 1 of this embodiment includes a control unit 12 for synchronizing the rotation of the sun gear 5 and the rotation of the internal gear 6. As shown in FIG. 3, in this example, the control unit 12 is connected to the upper and lower plates 2 and 3, the sun gear 5, the internal gear 6, and the work thickness measuring devices 11. In this example, the control unit 12 can control the rotations of the upper and lower rotating surface plates 4 (2, 3) as well as the rotation of the sun gear 5 and the rotation of the internal gear 6 with high precision to synchronize them. More specifically, in this example, the control unit 12 has a management control unit for managing and controlling the rotation of the sun gear 5, the rotation of the internal gear 6, and the rotations of the upper and lower rotating surface plates 4 (2, 3). This management control unit can ascertain or control the speed of the rotations and can ascertain the positions of the holes 10 provided in the upper and lower rotating surface plates 4 (2, 3). Further, the control unit 12 has an arithmetic unit for calculating the timing when the holes 10 come to be above the predetermined positions of one of the wafers W (that is, the time when the thicknesses of the wafer W can be measured through the holes 10 using the work thickness measuring devices 11) and has a determination unit having a logic for determining the end time of polishing from the results of the measurement of the thicknesses of the works using the work thickness measuring devices 11.

The operation and effect of the double-side polishing apparatus for a work according to this embodiment will now be described.

Figure 4:
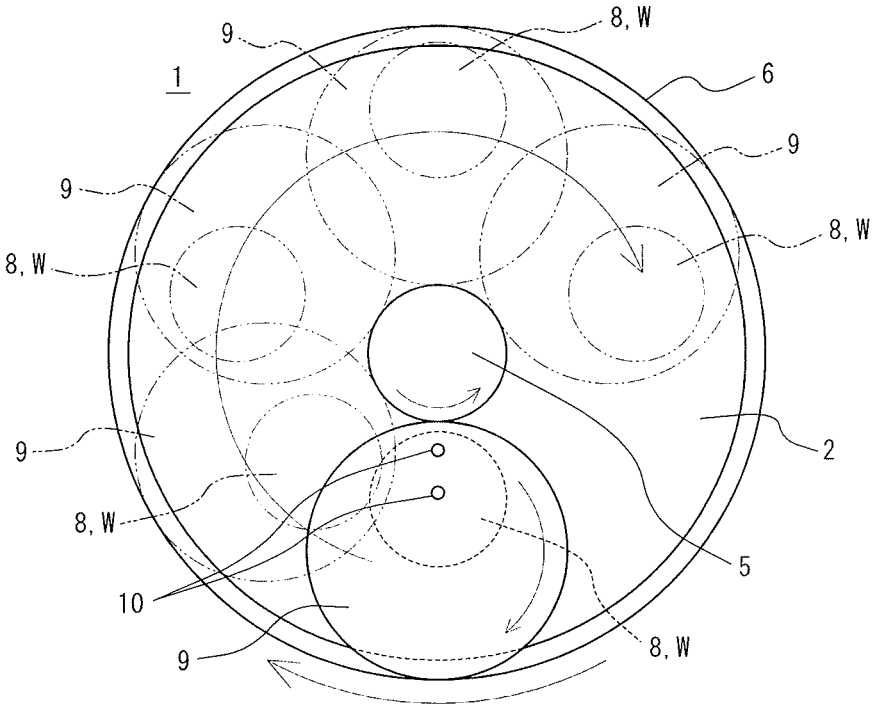
FIG. 4 is a plan view showing the state where the carrier plate is made to rotate and revolve, thereby performing double-side polishing.

The double-side polishing apparatus 1 for a work according to this embodiment primarily has a structure of a normal planetary gearing double-side polishing apparatus, so that the carrier plate 9 is rotated and revolved by the rotation of the sun gear 5 and the rotation of the internal gear 6 as shown in FIG. 4 until each wafer W acquires a predetermined thickness, thereby performing normal double-side polishing with high throughput. The "predetermined thickness" is not limited in particular. For example, it can be set to a thickness 0.0001 mm to 0.005 mm larger than the final target thickness of the wafers W. Further, since this apparatus includes work thickness measuring devices 11, it can measure the thickness of the wafers W in real time during double-side polishing, thereby determining whether the thickness of each wafer W reached the predetermined thickness or not.

Figure 5:
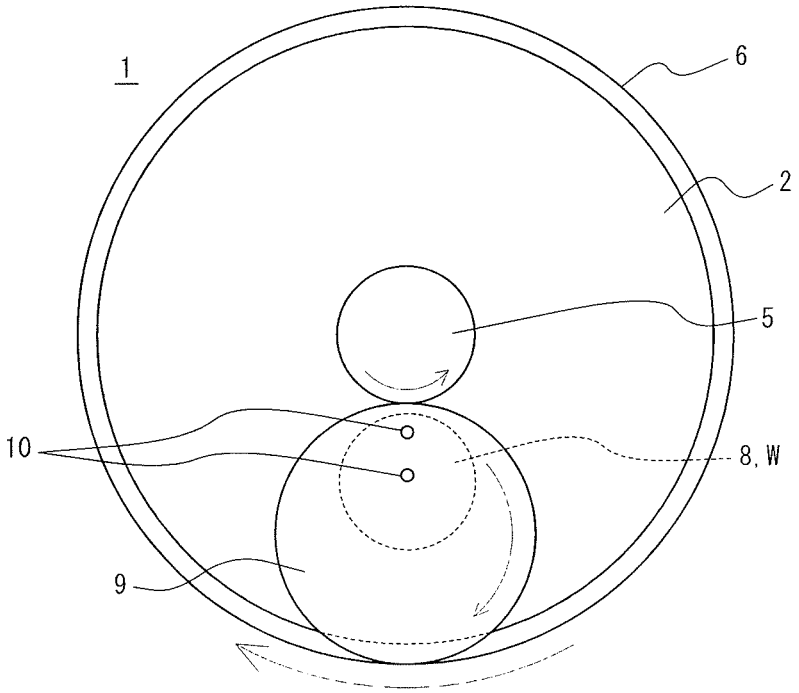
FIG. 5 is a plan view showing the state where the carrier plate is made to perform only rotation, thereby performing double-side polishing.

Next, as the thickness of each wafer W reaches the predetermined thickness, the rotation of the sun gear 5 and the rotation of the internal gear 6 are synchronized using the control unit 12 as shown in FIG. 5, thereby stopping the orbital motion of the carrier plate 9. The holes 10 provided in the upper plate 2 rotated at a predetermined rotational speed are located above the predetermined positions of the wafer W at regular intervals; on that occasion, the thickness of the wafer W can be measured through the holes 10 using the work thickness measuring devices 11. Accordingly, the above arithmetic unit can calculate the timing in which the holes 10 come to be located above the predetermined positions of the wafers W, from the cycle of the rotational motion of the carrier plate 9 and the cycle of the cycle of the rotation of the upper plate 2. In that timing, the thickness of the wafer W is measured through the holes 10 using the work thickness measuring devices 11, so that the information on the thickness of the wafer W at certain positions can be obtained. Thus, after the positions of the wafer W where the thickness is measured are ascertained, the thickness of the relevant positions can be measured in real time during double-side polishing.

After the thickness of each wafer W is found to reach the final target thickness by means of the work thickness measuring devices 11, the determination unit determines to terminate polishing; thus, polishing can be terminated. Using the apparatus of this embodiment, the measurement of the thickness can be performed only with respect to the predetermined positions of the wafer W as described above; thus, errors due to variation in the measurement positions can be precluded. Accordingly, the thickness of each wafer W can be ascertained accurately during double-side polishing of the wafer W; thus, polishing can be completed in a timely manner.

As described above, the double-side polishing apparatus for a work according to this embodiment renders repolishing required due to insufficient polishing unnecessary by accurate control of the polishing amount, which results in the improved productivity in the wafer production process. Further, the polishing amount can be kept from exceeding a desired amount, thereby also preventing the formation of wafer defects and the wear of the carrier plate.

Here, the double-side polishing apparatus 1 of the present invention, as in the above described embodiment, preferably includes a control unit 12 for synchronizing the rotation of the sun gear 5, the rotation of the internal gear 6, and the rotation of the upper plate 2 or the lower plate 3 having one or more holes 10. Thus, the rotational motion of the carrier plate 9 and the rotation of the upper plate 2 (or the lower plate 3) having the holes 10 can be synchronized. Consequently, control can be performed such that the predetermined positions of the wafer W coincide with the positions of the holes 10 provided in the upper plate 2 or the lower plate 3 per unit time with the highest frequency. Specifically, for example, control can be performed such that while the rotational motion of the carrier plate 9 makes the predetermined positions of the wafer W complete one rotation (rotated 360°), the holes 10 of the upper plate 2 (or the lower plate 3) complete N rotations (N is a natural number). Thus, the throughput for measuring the thickness of the predetermined positions of the work W can be improved.

Alternatively, in order to improve the throughput for measuring the thicknesses of the predetermined positions of the wafers W, a plurality of holes 10 can be provided on orbits on the upper plate 2 (or the lower plate 3)(on the two dot-dashed lines in the example shown in FIG. 2). For example, in the case where five holes 10 are provided at equal intervals on each dot-dashed line shown in FIG. 2, as compared with the case where one hole 10 is provided on each dot-dashed line, the data on the thickness of the certain positions of the wafer W can be obtained at quintuple throughput. On the other hand, when the rotational motions of the upper plate 2 (or the lower plate 3) and the carrier plate 9 were synchronized as described above, it is not necessary to provide a plurality of holes. Thus, while keeping the workload of polishing from being reduced, the throughput for measuring the thickness of the predetermined positions of the wafer W can be improved.

Further, in the present invention, when the carrier plate 9 performs only rotational motion without performing orbital motion as shown in FIG. 5, the holes 10 are preferably located such that the thickness of the center of the wafer W can be measured. Specifically, in the example shown in FIG. 2, the holes are preferably placed on one of the two dot-dashed lines on the outer side. In FIG. 5, one of the two holes 10 (the hole 10 on the outer side in the direction of the diameter of the upper plate 2) is located above the center of the wafer W at the time shown in the illustration. Here, when the carrier plate 9 performs rotational motion and the upper plate 2 (or the lower plate 3) is rotated, the hole 10 passes over the periphery of the wafer W as well. The timing can be calculated from the rotational speed of the carrier plate 9 or the rotational speed of the upper plate 2 (or the lower plate 3) using the arithmetic unit. Accordingly, when the hole 10 is located such that the thickness of the center of the wafer W can be measured, the thickness of the periphery of the wafer W can also be measured. Thus, the thickness of the wafer W can be measured at the center and the periphery of the wafer, so that the timing for terminating double-side polishing can be ascertained more appropriately considering not only the thickness of the wafer but also the shape of the wafer. Specifically, for example, a logic of monitoring the difference between the thickness of the center of the wafer W and the thickness of the periphery of the wafer W and terminating polishing at the time when the difference is minimized. Further, with such arrangement, only one hole 10 is required to be provided, so that reduction in the workload of polishing can be suppressed as compared with the case where a plurality of holes are provided. In addition, only one work thickness measuring device 11 is required to be provided, which can result in the reduced device cost.

Here, in the present invention, preferably two or more work thickness measuring devices 11 are provided, and two or more holes 10 are provided such that the thickness of a wafer W can be measured simultaneously at two or more different positions in the direction of the diameter of the wafer W using the two or more work thickness measuring devices 11 when the carrier plate 9 performs only rotational motion but not orbital motion as shown in FIG. 5. The two or more positions in the direction of the diameter of the wafer W can specifically be, for example, the center and the periphery of the wafer W as shown in FIG. 5. Thus, the thickness of the wafer can be measured at two or more different positions simultaneously in the direction of the diameter of the wafer W (for example, the center and the periphery of the wafer W). Therefore, not only the thickness of the wafer W but also the shape of the wafer W can be ascertained accurately with high throughput, which makes it possible to more accurately determine the time for terminating polishing.

<Double-Side Polishing of Work>

Next, a double-side polishing apparatus for a work according to one embodiment of the present invention will be described.

In a method of this embodiment, double-side polishing of the wafers W can be performed using for example, the apparatus shown in FIG. 2 and FIG. 3. Since the structure of the apparatus shown in FIG. 2 and FIG. 3 has already been described, the description will not be repeated. First, in the method of the present invention, both surfaces of the wafers W are polished by rotating and revolving the carrier plate 9 until the thicknesses of the wafers W reach a predetermined thickness (first polishing step). In the first polishing step, the wafers W are held by the carrier plate 9 provided with one or more openings 8 for holding the wafers W, the wafers W are sandwiched between the rotating surface plates 4 including the upper plate 2 and the lower plate 3, the rotation and the revolution of the carrier plate 9 are controlled by the rotation of the sun gear 5 provided at a center portion of the rotating surface plates 4 and the rotation of the internal gear 6 provided at a peripheral portion of the rotating surface plates 4. Thus, the rotating surface plates 4 and the carrier plate 9 are relatively rotated, thereby polishing both surfaces of the wafers W simultaneously. The "predetermined thickness" is not limited in particular as described above. For example, it can be set to a thickness 0.0001 mm to 0.005 mm larger than the final target thickness of the work.

In this first polishing step, the thickness of each wafer W is measured in real time through the one or more holes 10 (first measurement step). Note that as described above, the thickness of the wafer W can be measured using a work thickness measuring device 11, which is for example, a wavelength tunable infrared laser device.

In the above first measurement step, when the thicknesses of the wafers W are found to reach the predetermined thickness, the rotation of the sun gear 5 and the rotation of the internal gear 6 are synchronized, thereby performing control such that the carrier plate 9 stops orbital motion and only performs rotational motion. As described above, the control can be performed for example, by the control unit 12 having a management control unit for managing and controlling the speeds of the rotation of the sun gear 5, the rotation of the internal gear 6, and the rotations of the upper and lower rotating surface plates 4 (2, 3) as shown in FIG. 3.

Subsequently, both surfaces of the wafers W are polished while the carrier plate 9 performs only rotational motion.

(Second Polishing Step)

In the second polishing step, the thickness of each wafer W is measured at the above predetermined positions through the one or more holes 10 (Second measurement step). Since the upper and lower surface plates 4 (2, 3) are also rotated at a predetermined speed in the second polishing step, in the example of using the apparatus shown in FIG. 2 and FIG. 3, the holes 10 provided in the upper plate 2 are located above the predetermined positions of the wafer W at certain intervals, which then allows the thickness of the wafers W to be measured by the work thickness measuring devices 11 placed above the upper plate 2. As in the first measurement step, the thickness of the wafers W can be measured for example using the work thickness measuring devices 11 which are wavelength tunable infrared laser devices.

Based on the results of measuring the thicknesses of the wafers W in the second measurement step, the time for terminating polishing can be determined. Specifically, when the thickness of each wafer W is found to reach a target thickness at predetermined positions, for example polishing can be terminated. Thus, according to the double-side polishing method for a work according to this embodiment, polishing can be terminated in a timely manner by while polishing works, ascertaining the thickness of the works accurately.

In the double-side polishing method for a work according to the present invention, for the same reason as described above, when the thicknesses of the wafers W are found to reach a predetermined thickness in the first measurement step, in addition to the rotation of the sun gear 5 and the rotation of the internal gear 6, the rotation of the upper plate 2 or the lower plate 3 having one or more holes 10 is preferably synchronized. Further, for the same reason as described above, in the second measurement step, it is preferable to measure the thickness of the center of the wafers W through the holes 10 provided in the upper plate 2 or the lower plate 3. Furthermore, for the same reason as described above, in the second measurement step, it is preferable to measure the thickness of each wafer W at two or more different positions in the direction of the diameter of the wafer W through the holes 10 provided in the upper plate 2 or the lower plate 3 using the two or more work thickness measuring devices 11. In particular, it is preferable to simultaneously measure the thicknesses of at least one point in the center of each wafer W and at least one point in the periphery thereof.

Examples of the present invention are described below; however, the present invention is not limited to those Examples.

EXAMPLES

In order to confirm the effects of the present invention, a double-side polishing apparatus and a double-side polishing method of the present invention were used to perform a test for comparing the flatness of wafers between cases where the end point of double-side polishing was detected and cases where the polishing time was managed by an operator.

In the above test, a p-type silicon wafer having a diameter of 300 mm with crystal orientation (001) was used. Suba 800 (manufactured by RODEL NITTA COMPANY) was used as a polishing pad and Nalco 2350 (manufactured by RODEL NITTA COMPANY) was used as a polishing slurry. Further, the speed of the rotation of the upper and lower plates was 25 rpm to 30 rpm, whereas the working pressure applied to the surfaces was 300 g/cm$^2$. As a carrier plate, a stainless steel material having a thickness of 775 μm was used and the target thickness of the wafer was set to 777 μm. Further, as a work thickness measuring device, c11011 (manufactured by Hamamatsu Photonics K. K.) was used.

Note that an apparatus based on the structure shown in FIG. 2 and FIG. 3 was used for the test. For the measurement of the thickness of the wafers, as shown in FIG. 2 and FIG. 3, observation holes were provided at two positions of the upper plate 2.

Figure 6:
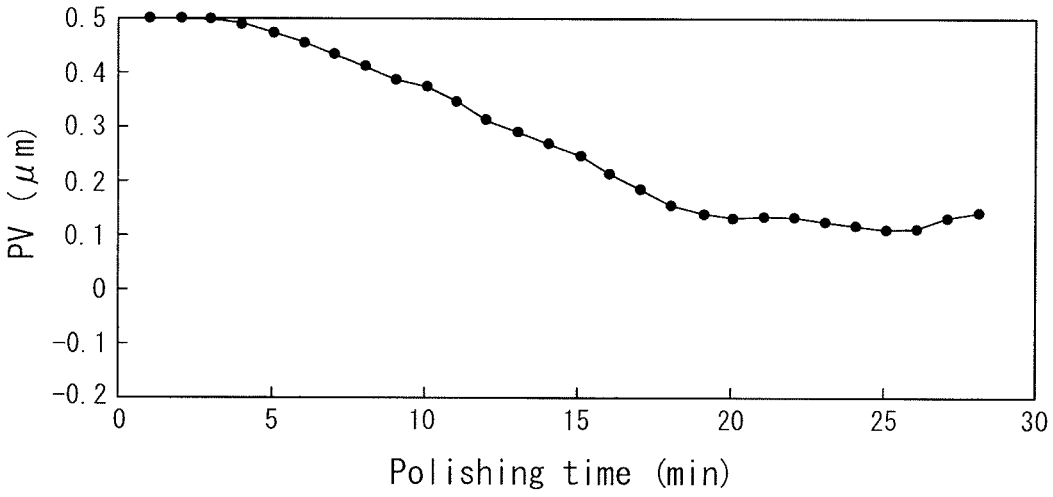
FIG. 6 is a diagram showing the relationship between the polishing time and the PV.

Here, in this example, double-side polishing was performed first by rotating and revolving the carrier plate; meanwhile, the thicknesses of the center (center of gravity position) and the periphery (about 1 mm inner in the diameter direction from the outermost periphery) of a wafer were measured in real time using the above work thickness measuring devices. When the thickness of the center of the carrier plate became 776 μm, the rotation of the sun gear and the rotation of the internal gear were synchronized to terminate the revolution of the carrier plate. Then, the carrier plate was rotated (without performing orbital motion), and meanwhile, the thickness of the wafer was measured. In this measurement, only data on the cases where the wafer being polished was within the innermost area of the upper plate (for example, in the position shown in FIG. 5) were extracted. As shown in FIG. 6, a logic was applied in which the difference between the thicknesses of the center (center of gravity position) and the periphery (about 1 mm inner in the diameter direction from the outermost periphery) of the wafer was calculated as a PV (peak value), and the polishing was terminated when the PV exceeded the minimum value.

Under the above polishing conditions, continuous five cycles of polishing were performed and after one-day suspension, another five cycles of polishing were performed. Here, the thickness of the center of each wafer was used as an index of flatness, other than that, a GBIR (global backside ideal focal plane range) was used as an index of the entire shape, and an ESFQR (Edge flatness metric, Sector based, Front surface referenced, Site Front least sQuares Range) was used as an index of the shape of the periphery. Here, the GBIR can be found specifically by calculating the difference between the maximum thickness and the minimum thickness of the entire wafer on the basis of the rear surface of the wafer that is assumed to be completely stuck. In this example, a flatness measurement system (WaferSight manufactured by KLA-Tencor) was used for the measurement. Further, an ESFQR is an SFQR measured with respect to fan-shaped regions (sectors) formed in the entire peripheral area of the wafer, and a smaller ESFQR means that the flatness is higher. In this example, a flatness measurement system (WaferSight manufactured by KLA-Tencor) was used for the measurement. Note that an SFQR (Site Front least sQuares Range) is an index showing the flatness of a wafer, according to SEMI standard. The SFQR is obtained specifically by obtaining a plurality of samples having a specific size from a wafer, and calculating the maximum displacement from a reference plane obtained by the least square method with respect to each sample obtained.

Figure 7A:
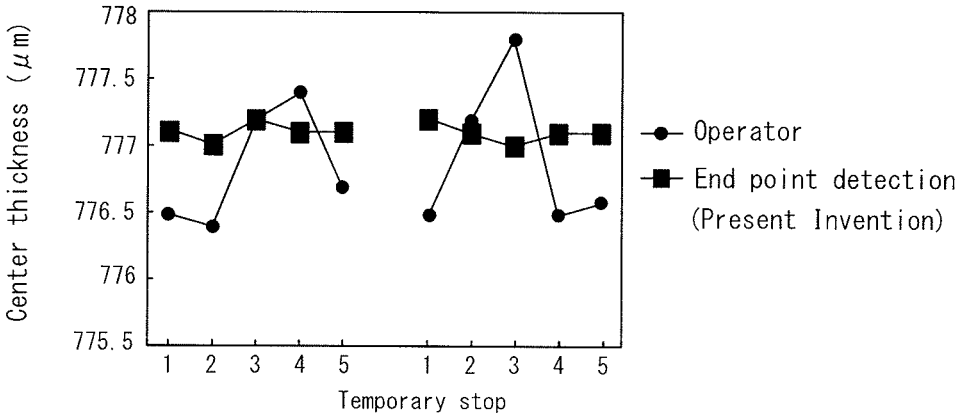
FIGS. 7(*a*) to 7(*c*) are diagrams showing the test results of Examples.
Figure 7B:
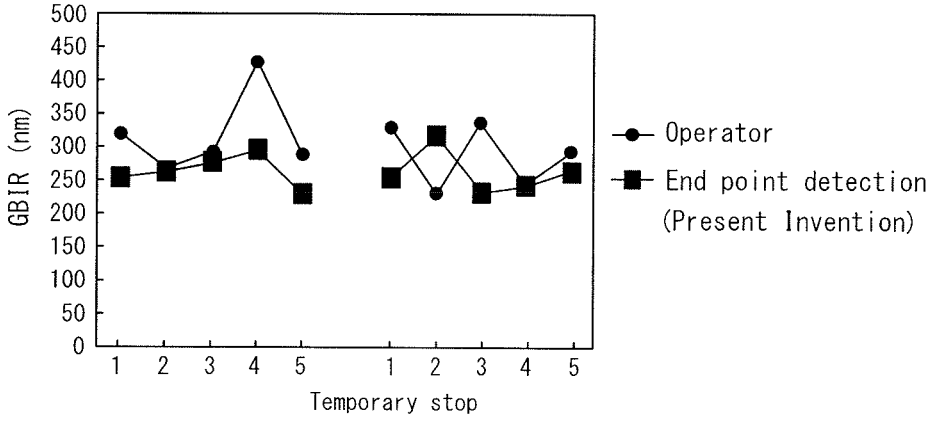
Figure 7C:
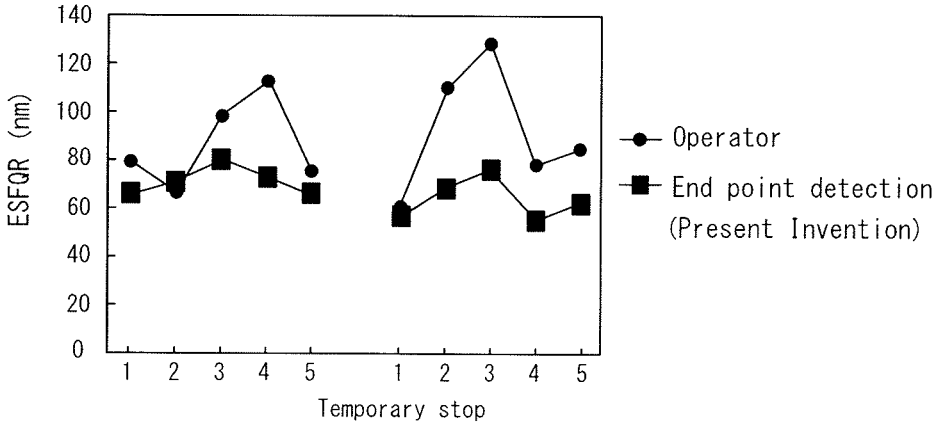

FIG. 7(*a*) to 7(*c*) are diagrams showing the results of the above tests. As shown in FIG. 7(*a*), in the technique where the polishing time is managed by an operator, the thickness of the wafer may differ from the target thickness, and the center thickness of the finished wafer varies between the cycles, in some cases. On the other hand, according to the present invention, the wafers can be finished to have a thickness close to the targeted center thickness in each cycle and the variation between the cycles is small. Further, as shown in FIG. 7(*b*), in the technique where the polishing time is controlled by an operator, the GBIR was relatively high as a whole, and the GBIR seemed to vary between the cycles. On the other hand, according to the present invention, the GBIR was small in each cycle; accordingly, the flatness of the entire surface of each wafer was high, and the variation between the cycles also appeared to be small. Further, as shown in FIG. 7(*c*), in the technique where the polishing time is managed by an operator, the ESFQR was relatively high as a whole, and the GBIR seemed to vary between the cycles. On the other hand, according to the present invention, the ESFQR was small in each cycle; accordingly, the flatness of the periphery of each wafer was high, and the variation between the cycles also appeared to be small. From the above, in accordance with the double-side polishing apparatus and the double-side polishing method for a work according to the present invention, while a work is polished, the thickness of the work can be ascertained accurately, which allowed the polishing to be terminated in a timely manner.

INDUSTRIAL APPLICABILITY

The present invention can provide a double-side polishing apparatus and a double-side polishing method for a work, which make it possible to terminate polishing in a timely manner by while polishing a work, ascertaining the thickness of the work accurately.

REFERENCE SIGNS LIST

1: Double-side polishing apparatus, 2: Upper plate, 3: Lower plate, 4: Rotating surface plate, 5: Sun gear, 6: Internal gear, 7: Polishing pad, 8: Opening, 9: Carrier plate, 10: Hole, 11: Work thickness measuring device, 12: Control unit, W: Work (Wafer)

The invention claimed is:

1. A double-side polishing apparatus for a work, including rotating surface plates having an upper plate and a lower plate, a sun gear provided at a center portion of each rotating surface plate, an internal gear provided at a peripheral portion of each rotating surface plate, and a carrier plate provided between the upper plate and the lower plate provided with one or more openings for holding the work, wherein the upper plate or the lower plate has one or more holes penetrating from the top surface to the bottom surface of said upper plate or said lower plate, and the double-side polishing apparatus comprises:

one or more work thickness measuring devices which can measure the thickness of each work through the one or more holes in real time while double-side polishing the work; and a control unit for synchronizing the rotation of the sun gear and the rotation of the internal gear.

2. The double-side polishing apparatus according to claim 1, comprising a control unit for synchronizing the rotation of the sun gear, the rotation of the internal gear, and the rotation of the upper plate or the lower plate having the one or more holes.

3. The double-side polishing apparatus according to claim 1, wherein the hole is placed at a position such that the thickness of the center of the work can be measured while the carrier plate performs only rotational motion.

4. The double-side polishing apparatus according to claim 1, wherein the number of the work thickness measuring devices is two or more, and the number of the holes is two or more such that when the carrier plate performs only rotational motion, the thicknesses of the work can be measured simultaneously at two different positions in the diameter direction of the work with the two or more work thickness measuring devices.

5. A double-side polishing method for a work, wherein a work is held by a carrier plate provided with one or more openings for holding the work; the work is sandwiched between rotating surface plates composed of an upper plate and a lower plate; the rotation and the revolution of the carrier plate are controlled by the rotation of a sun gear provided at a center portion of each rotating surface plate and the rotation of an internal gear provided at a peripheral portion of each rotating surface plate; and thus the rotating surface plates and the carrier plate are relatively rotated to simultaneously polish both surfaces of the work, the upper plate or the lower plate has one or more holes penetrating from the top surface to the bottom surface of said upper plate or said lower plate, and the double-side polishing method for a work comprises the steps of:

first polishing for polishing both surfaces of the work by the rotation and the revolution of the carrier plate such that the thickness of the work attain a predetermined thickness;

first measurement for measuring the thickness of the work through the one or more holes in real time during the first polishing step;

in the first measurement step, when the thickness of the work is found to reach the predetermined thickness, terminating the orbital motion of the carrier plate by synchronizing the rotation of the sun gear and the rotation of the internal gear;

second polishing for polishing both surfaces of the work while the carrier plate performs only rotational motion;

second measurement for measuring the thickness of the work at predetermined position(s) through the one or more holes in real time during the second polishing step; and determining a time for terminating polishing based on the result of the measurement of the thickness of the work in the second measurement step.

* * * * *